US006431522B1

(12) United States Patent
Cutrell, Sr. et al.

(10) Patent No.: US 6,431,522 B1
(45) Date of Patent: Aug. 13, 2002

(54) CLAMPING BASE FOR HYDRAULIC SPREADER

(76) Inventors: Edward G. Cutrell, Sr.; Edward G. Cutrell, Jr., both of 1220 Executive Blvd., Suite 107, Chesapeake, VA (US) 23320

( * ) Notice: Subject to any disclaimer, the term of this patent is extended or adjusted under 35 U.S.C. 154(b) by 0 days.

(21) Appl. No.: 09/323,835

(22) Filed: Jun. 2, 1999

(51) Int. Cl.[7] ..... B66F 3/24
(52) U.S. Cl. ..... 254/1; 254/93 R
(58) Field of Search ..... 72/422, 705; 254/1, 254/DIG. 1, 93 R; 269/49, 133

(56) References Cited

U.S. PATENT DOCUMENTS

| | | | | | |
|---|---|---|---|---|---|
| 2,151,063 | A | | 3/1939 | Weaver | |
| 3,613,764 | A | * | 10/1971 | Guenard | 157/1.26 |
| 3,667,275 | A | | 6/1972 | Hunnicutt | |
| 4,158,955 | A | * | 6/1979 | Bustin | 72/414 |
| 4,443,001 | A | * | 4/1984 | Haerer | 254/93 R |
| 4,549,423 | A | | 10/1985 | Masui | |
| 4,736,927 | A | * | 4/1988 | Clancy | 254/93 R |
| 4,747,590 | A | * | 5/1988 | Yang | 269/45 |
| 5,289,711 | A | | 3/1994 | Spiegel | |
| 5,613,397 | A | | 3/1997 | Johansson | |
| 5,622,353 | A | | 4/1997 | Painter et al. | |
| 5,732,932 | A | * | 3/1998 | Michalo | 254/93 R |
| 5,791,033 | A | * | 8/1998 | Norby et al. | 254/93 R |
| 5,810,333 | A | * | 9/1998 | Hickerson et al. | 254/93 R |
| 5,821,416 | A | * | 10/1998 | Hjort-Hansen | 254/93 R |
| 5,848,783 | A | * | 12/1998 | Weissenborn | 269/97 |
| 5,904,340 | A | * | 5/1999 | Allamon | 254/93 R |

* cited by examiner

*Primary Examiner*—Joseph J. Hail, III
*Assistant Examiner*—Daniel Shanley
(74) *Attorney, Agent, or Firm*—Robert N. Blackmon

(57) ABSTRACT

A base for a hydraulic spreading ram for rescue work with crushed or collapsed motor vehicle bodies wherein the body must be spread to extricate a trapped victim. The base is U-shaped, having parallel upper and lower arms, and a vertical connecting arm spanning and connecting the upper and lower arms. A stationary jaw is fixed to the lower arm. A movable jaw is constrained to slide along the vertical connecting arm by guide plates fixed to the movable jaw and which ride along grooves formed in the vertical connecting arm. The upper arm is aligned with the lower arm, and has a threaded opening for receiving a correspondingly threaded hydraulic ram in an orientation such that the ram forces the movable jaw downwardly towards the stationary jaw. The movable jaw has two receptacles each disposed to receive a ram which is employed to spread the vehicle body. The two receptacles provide a selection of positions for the ram which spreads the vehicle body.

11 Claims, 2 Drawing Sheets

CLAMPING BASE FOR HYDRAULIC SPREADER

BACKGROUND OF THE INVENTION

1. Field of the Invention

The present invention relates to the field of tools for expanding crushed motor vehicle bodies to extricate collision victims. The invention is a base intended to be employed in conjunction with one or more hydraulic rams. The base clamps to an advantageous point on a vehicle from which a collision victim is to be extricated, and rams are seated on the base. With firm anchorage afforded by the base, the rams may then be employed to expand the crushed vehicle body.

2. Description of the Prior Art

It is occasionally necessary to extricate a victim from the crushed body of a motor vehicle that has been involved in a collision which has entrapped the victim. Motor vehicle bodies are usually fabricated from steel, and cannot be spread open readily to gain access to victims. Hydraulic expanding equipment has been provided to assist rescue personnel in freeing trapped victims. Such equipment may include spreading arms, as seen in U.S. Pat. No. 5,622,353, issued to Alan J. Painter et al. on Apr. 22, 1997, or hydraulic rams which can develop sufficient force to spread the crushed vehicle sufficiently to extricate victims.

It is not always convenient or easy to wield spreaders. A chronic shortcoming of spreaders and rams is that there is frequently no solid mounting point to anchor the idle end of the ram. U.S. Pat. No. 5,289,711, issued to Leo J. Spiegel on Mar. 1, 1994, sets forth a spreader designed to cope with the many problems which may arise in bringing a rescue device to bear to good effect. Among the problems frequently encountered by rescuers is that there is no solid mounting for a ram or other spreader. The body may be twisted to a highly irregular shape, or the body at a point opposite that which is to be forced open may lack a solid foundation capable of anchoring the idle end of the ram. Available structure of the body may be too weak to support or anchor a ram effectively.

It is frequently necessary to build an impromptu support base for a ram or spreader. However, there are problems with this approach. For example, a base may spontaneously fail, with consequent injury to the victim, rescuer, or both.

Spiegel sets forth an elongate tube or channel along which slides a carriage which may be locked in place at a selected point along the tube or channel. The carriage is adapted to receive and support a hydraulic ram. Connection of the ram is by passing a pin through a clevis formed in the carriage. The pin passes through a hole formed in the base of the ram.

By contrast, the present invention provides a compact yet powerful clamp which closes over and securely holds a limited portion of the vehicle body. No open space corresponding to the length of the elongate tube of Spiegel is required. A ram which is to be supported on the novel clamp need not have a member adapted to receive a pin, in the manner of Spiegel.

Expanding devices which have an integral clamp and which work in conjunction with one or more hydraulic rams are seen in U.S. Pat. No. 2,151,063, issued to Ira A. Weaver on Mar. 21, 1939, U.S. Pat. No. 3,667,275, issued to Wayne E. Hunnicutt on Jun. 6, 1972, and U.S. Pat. No. 4,549,423, issued to Saburo Masui on Oct. 29, 1985. These devices engage the subject vehicle at several points, and must cooperate with the vehicle body in a way which is frequently not possible in emergency situations following a collision. In fact, the three above listed patents would likely not be able to engage a vehicle body which was severely distorted in a collision, as can the present invention. The present invention is adapted to seize and anchor to a single, limited point on the body of the subject vehicle.

U.S. Pat. No. 5,613,397, issued to Uno Johansson on Mar. 25, 1997, illustrates a clamp having faces textured to engage a vehicle body. However, there is no provision for seating a hydraulic ram, and the configuration of the clamp differs significantly from that of the present invention.

None of the above inventions and patents, taken either singly or in combination, is seen to describe the instant invention as claimed.

SUMMARY OF THE INVENTION

The present invention sets forth a powerful clamp which can grasp a member of a vehicle body with sufficient force to resist being displaced when one or more hydraulic rams is seated thereon and expanded to engage and spread the crushed or collapsed body of the vehicle. The novel device includes a clamp having a base, a first jaw fixed to the base, and a second jaw slidably mounted on the base such that it can be moved towards the stationary jaw. The base or the upper jaw is provided with seat structure for receiving and supporting one end of a hydraulic ram.

The movable upper jaw is propelled downwardly towards the upwardly facing stationary jaw by a conventional hydraulic ram which is threaded into the upper jaw. Any convenient source of hydraulic pressure may then be employed to close the jaws over a member of the vehicle. There is no necessity to build an impromptu base. The upper jaw has guide plates which ride in grooves formed in the base, so that the upper jaw is constrained to move only towards and away from the stationary jaw.

The upper jaw has at least two receptacles formed by intersecting horizontal and vertical plates. Each receptacle opens upwardly and laterally, and can seat and anchor the end of at least one hydraulic ram. The receptacles open in several directions, so that rams may be variably positioned when seated therein. Conventional rams may then be place on the seat after the clamp is locked in place at a selected point on the vehicle body, and expanded to spread open a collapsed vehicle body.

The clamp is fairly compact, light in weight, and yet very sturdy and well suited for the task. The clamp is therefore highly portable, and need not be employed with rams specially designed or adapted to cooperate therewith.

Accordingly, it is a principal object of the invention to provide a base for powered spreading equipment for expanding crushed or collapsed vehicle bodies.

It is another object of the invention that the base be capable of engaging and securely anchoring at a deformed portion of the vehicle body.

It is a further object of the invention to be able to clamp the novel base to a vehicle body with a conventional hydraulic ram.

Still another object of the invention is to provide at least one seat for receiving the idle end of a conventional hydraulic ram.

A further object of the invention is that a conventional hydraulic ram be variably positioned on the base.

An additional object of the invention is that the novel base be compact and sturdy.

Yet another object of the invention is to avoid the necessity of building an impromptu base for a spreader or ram.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
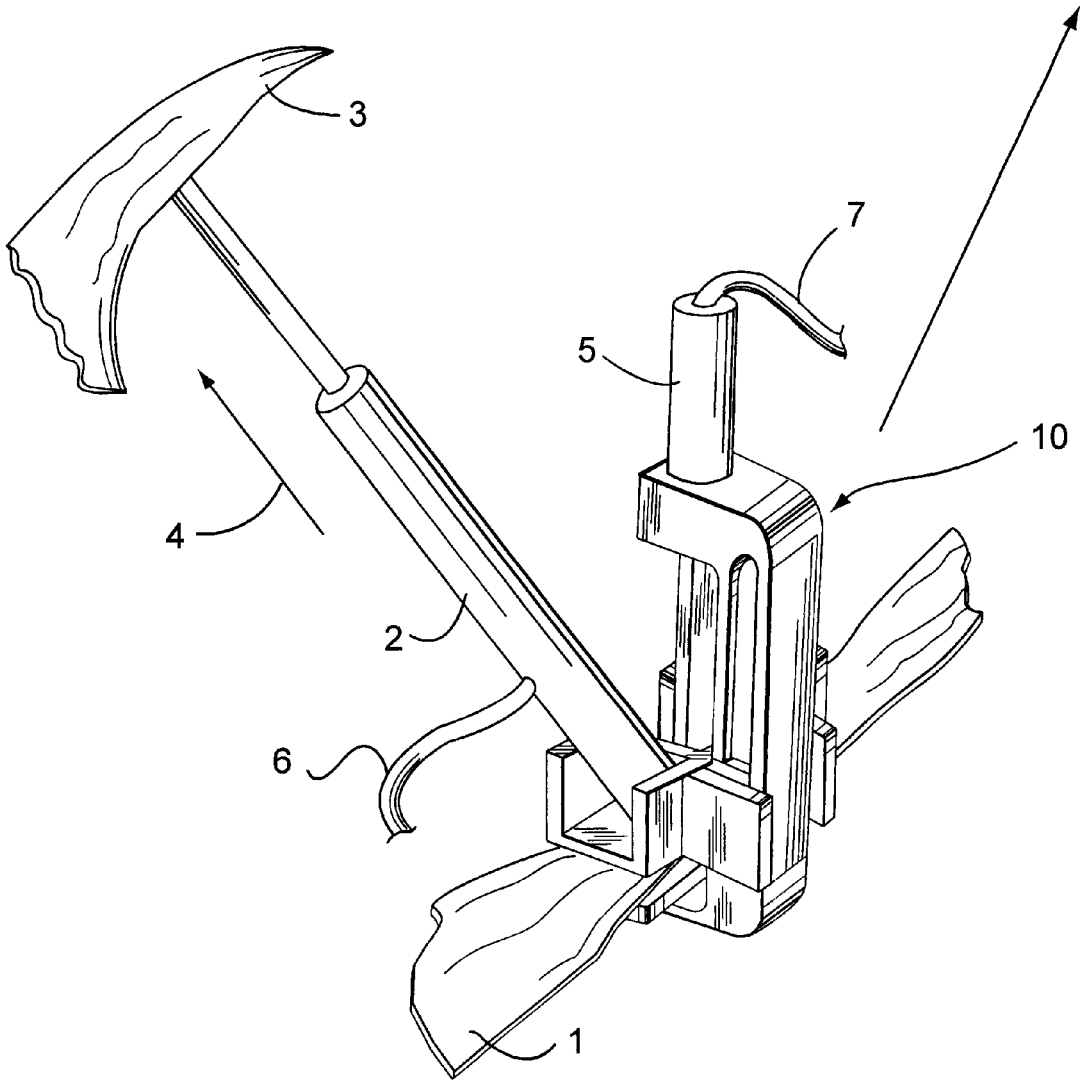
FIG. 1 is an environmental, perspective view of the invention.

Turning now to FIG. 1 of the drawings, clamping base 10 is shown clamped to a first portion 1 of a motor vehicle (not shown in its entirety). A ram 2 for expanding a second portion 3 of the vehicle is shown seated and firmly anchored to base 10. Ram 2 expands in a direction indicated by arrow 4. When expanded in the direction of arrow 4, ram 2 forces portion 3 away from portion 1, thereby establishing a path of egress for a person (not shown) entrapped within the crushed or collapsed body of the vehicle. Force acting in a direction opposite arrow 4 is resisted by clamping base 10, which has secure anchorage by virtue of clamping portion 1 to the point that portion 1 becomes somewhat distorted.

Clamping base 10 develops sufficient force to crush portion 3 due to a second hydraulic ram 5 which is threaded into clamping base 10. Rams 2, 5 may be conventional rams which are hydraulically operated. Respective fluid supply hoses 6, 7 represent manual or powered sources of fluid pressure (not shown in their entirety).FIG.

Figure 2:
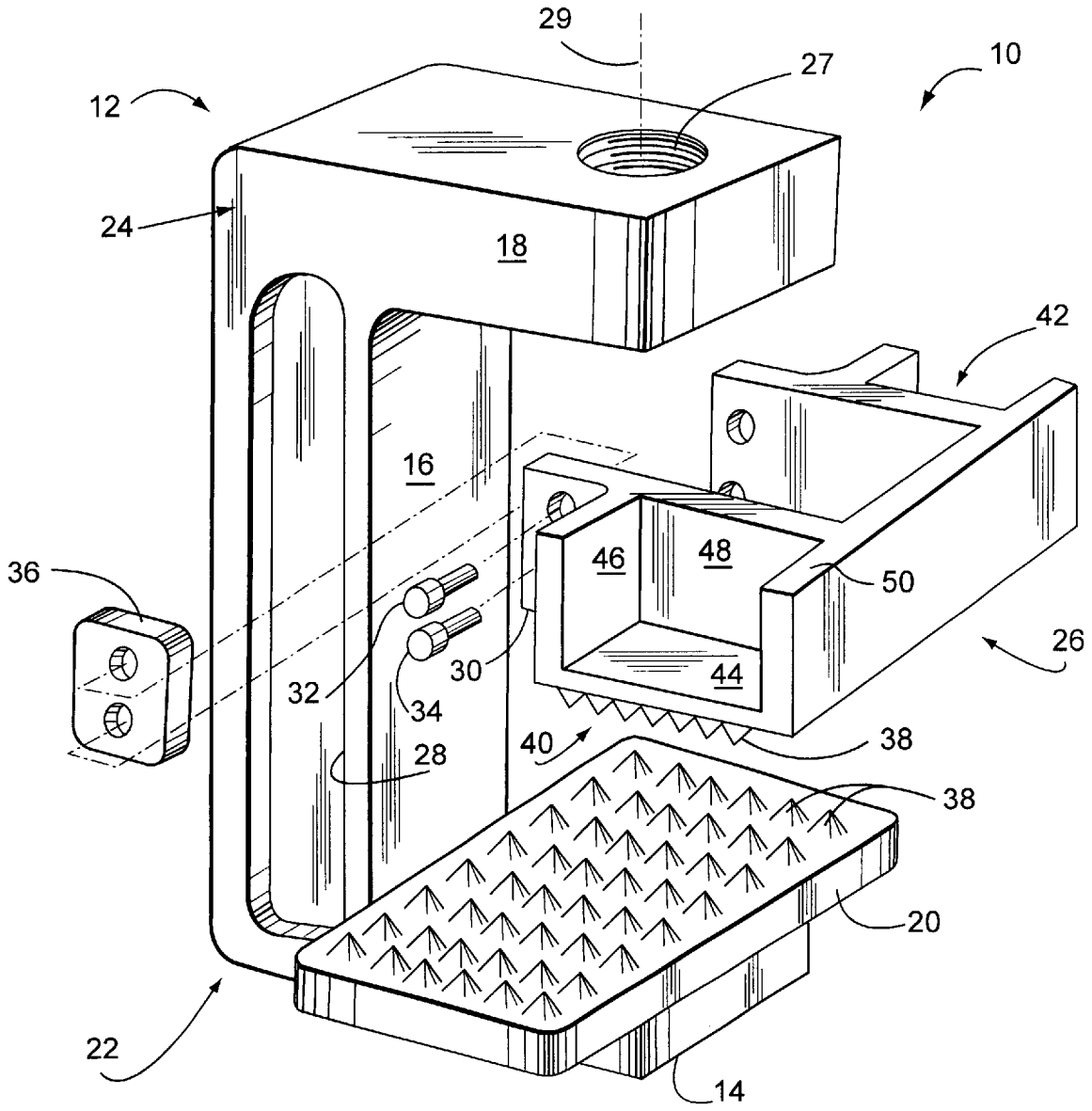
FIG. 2 is an enlarged, exploded, perspective detail view of the invention.

FIG. 2 shows the structure of clamping base 10. Base 10 has a generally C-shaped or U-shaped guide post 12 having three sections 14, 16, 18. A first horizontal section 14 supports a stationary jaw 20 which is solidly attached to the distal end of guide post 12. The distal end is that shown at the bottom of FIG. 2. A vertical second section 16 projects upwardly from section 14 at the proximal end 22 of section 14. A second horizontal section 18 projects horizontally from vertical section 16 at the proximal end 24 of horizontal section 18. Horizontal sections 14, 18 are vertically aligned one above the other.

Guide post 12 supports and guides a movable clamp jaw 26, which is slidably disposed upon guide post 12 and secured thereto in the following manner. A groove 28 is formed in the side of vertical section 16 of guide post 12, and extends along guide post 12 in a longitudinal direction relative to section 16 of guide post 12. The longitudinal direction is parallel to axis 29, and coincides with the direction of motion of movable jaw 26. Movable jaw 26 has an arm 30 drilled to receive fasteners 32, 34, which thread into a guide plate 36, firmly securing guide plate 36 between arm. 30 and guide post 12. A second guide plate (concealed in the depiction of FIG. 2) is provided for the other side of jaw 26, and is essentially a mirror image of guide plate 36. Guide plate 36 is dimensioned and configured to partially occupy and ride within groove 28, and constrains jaw 26 to move only towards and away from stationary jaw 20. This occurs in conjunction with the second guide plate, which occupies a corresponding groove (not visible in FIG. 2) disposed on the opposite side of guide post 12. Both jaws 20, 26 preferably have teeth 38 for engaging and improving grasp on the body of the vehicle.

Horizontal section 18 supports a connector disposed to removably receive ram 5 in an orientation such that ram 5 moves movable jaw 26 towards stationary jaw 20 when ram 5 is expanded. The connector is, in the embodiment depicted in FIG. 2, a threaded opening 27 disposed above and in vertical alignment with movable jaw 26. The threaded opening is preferably centered over jaw 26 so that force imposed by ram 5 will act evenly and symmetrically on jaw 26. Axis 29 indicates the center line of opening 27.

Movable jaw 26 has two receptacles 40, 42. Receptacle 40 is dimensioned and configured to seat ram 2 thereon in a first orientation wherein ram 2 can expand in a direction away from stationary jaw 20. Direction of expansion is shown as arrow 4 in FIG. 1. Receptacle 42 is dimensioned and configured to seat ram 2 or still an additional ram (not shown) on jaw 26 such that the second ram can expand in a direction different from that of the first ram. Preferably, receptacles 40 and 42 open in opposed directions, so that maximal versatility is possible in positioning at least one ram against the body of the vehicle. In the depiction of FIG. 2, the directions are respectively to the lower left and to the upper right. Receptacles 40, 42 are connected to and supported in a fixed position by and relative to guide post 12 when movable jaw 26 is not moving.

Receptacle 40 has a horizontal floor 44 and upright vertical walls 46, 48, 50 closing floor 44 in three orthogonal directions. Receptacle 40 opens in a direction away from guide post 12, when jaw 26 and guide plate 36 are assembled to guide post 12. Directions such as "horizontal" and "vertical" refer to clamping base 10 as it is depicted in FIG. 2. Of course, base 10 may be employed in any position, and "horizontal" and "vertical", as employed for description, are for semantic convenience only.

The present invention may be modified without departing from the inventive concept. For example, the connector for attaching ram 5 could be other than threaded hole. In another example, receptacles 40, 42 could if desired be formed on section 18 of guide post 12. Guide plate 36 could be formed to surround or otherwise cooperate with vertical section 16 of guide post 12.

It is to be understood that the present invention is not limited to the embodiments described above, but encompasses any and all embodiments within the scope of the following claims.

We claim:

1. A clamping base for a hydraulic spreading tool having a first ram for clamping to a body of a motor vehicle and a second ram for expanding the body of the motor vehicle, said base comprising:

an elongate guide post having a distal end and a proximal end;

a stationary jaw solidly attached to said guide post proximate said distal end of said guide post;

a movable jaw slidably disposed upon said guide post and constrained to move only towards and away from said stationary jaw;

a connector disposed to removably receive the first ram and hold the first ram in place on said clamping base in an orientation wherein expansion of the first ram moves said movable jaw towards said stationary jaw; and a first receptacle dimensioned and configured to seat the second ram thereon in a first-orientation wherein the second ram can expand in a direction away from said stationary jaw, wherein said receptacle is connected to and supported in a fixed position by and relative to said guide post when said movable jaw is not moving.

2. The clamping base according to claim 1, further comprising a second receptacle dimensioned and configured to seat the second ram thereon in a second orientation wherein the second ram can expand in a second direction away from said stationary jaw, wherein said second direction is different from any direction that can be achieved employing said first receptacle, and wherein said second receptacle is connected to and supported in a fixed position by and relative to said guide post when said movable jaw is not moving.

3. The clamping base according to claim 2, wherein said first receptacle and said second receptacle are part of said movable jaw.

4. The clamping base according to claim 2, wherein said first receptacle and said second receptacle open in opposed directions.

5. The clamping base according to claim 1, wherein said first receptacle has a horizontal floor and upright vertical walls closing said horizontal floor in three orthogonal directions and opening in a direction away from said guide post.

6. The clamping base according to claim 1, wherein said guide post has a groove formed therein, wherein said groove extends along said guide post in a longitudinal direction, and said movable jaw has a guide plate dimensioned and configured to partially occupy and ride within said groove.

7. The clamping base according to claim 1, wherein said connector comprises a threaded opening disposed above and in vertical alignment with said movable jaw.

8. The clamping base according to claim 1, wherein said guide post has three sections including a first horizontal section having a proximal end, a vertical section projecting upwardly at said proximal end of said horizontal section, and a second horizontal section having a proximal end, said second horizontal section projecting horizontally from said vertical section at said proximal end of said second horizontal section, wherein said first horizontal section and said second horizontal are vertically aligned one above the other.

9. The clamping base according to claim 1, wherein said stationary jaw has teeth for engaging the vehicle body.

10. The clamping base according to claim 1, wherein said movable jaw has teeth for engaging the vehicle body.

11. A clamping base for a hydraulic spreading tool having a first ram for clamping to a body of a motor vehicle and a second ram for expanding the body of the motor vehicle, said base comprising:

an elongate guide post having three sections including a first horizontal section having a proximal end, a vertical section projecting upwardly at said proximal end of said horizontal section said vertical section having a lower end and an upper end, and a second horizontal section having a proximal end, said second horizontal section projecting horizontally from said vertical section at said proximal end of said second horizontal section, wherein said first horizontal section and said second horizontal are vertically aligned one above the other, a distal end located at the lower end of said vertical section, and a proximal end located at the upper end of said vertical section;

a stationary jaw solidly attached to said guide post proximate said distal end of said guide post, wherein said stationary jaw has teeth for engaging the vehicle body;

a movable jaw slidably disposed upon said guide post and constrained to move only towards and away from said stationary jaw, wherein said movable jaw has teeth for engaging the vehicle body;

a connector disposed to removably receive the first ram and hold the first ram in place on said clamping base in an orientation wherein expansion of the first ram moves said movable jaw towards said stationary jaw, said connector comprising a threaded opening formed in said guide post, disposed above and in vertical alignment with said movable jaw;

a first receptacle dimensioned and configured to seat the second ram thereon in a first orientation wherein the second ram can expand in a direction away from said stationary jaw, wherein said first receptacle has a horizontal floor and upright vertical walls closing said horizontal floor in three orthogonal directions and opening in a direction away from said guide post, and wherein said receptacle is formed as part of said movable jaw; and a second receptacle dimensioned and configured to seat the second ram thereon in a second orientation wherein the second ram can expand in a second direction away from said stationary jaw, wherein said second direction is selectively different from any direction that can be achieved employing said first receptacle, and wherein said second receptacle is formed as part of said movable jaw, said second receptacle opens in a direction opposite that of said first receptacle, and said second receptacle has a horizontal floor and upright vertical walls closing said horizontal floor in three orthogonal directions and opening in a direction away from said guide post, wherein said guide post has a groove formed therein, wherein said groove extends along said guide post in a longitudinal direction, and said movable jaw has a guide plate dimensioned and configured to partially occupy and ride within said groove.

* * * * *